US008939067B2

(12) United States Patent
Lee et al.

(10) Patent No.: US 8,939,067 B2
(45) Date of Patent: Jan. 27, 2015

(54) COOKER

(75) Inventors: Young Jun Lee, Seoul (KR); Yang Kyeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 624 days.

(21) Appl. No.: 12/773,100

(22) Filed: May 4, 2010

(65) Prior Publication Data

US 2010/0294139 A1 Nov. 25, 2010

(30) Foreign Application Priority Data

May 20, 2009 (KR) ..... 10-2009-0043926

(51) Int. Cl.
*A47J 37/07* (2006.01)
*A21B 1/22* (2006.01)
*F24C 7/06* (2006.01)

(52) U.S. Cl.
CPC ..... *F24C 7/06* (2013.01)
USPC ..... 99/401; 99/447; 99/467; 219/405; 219/411

(58) Field of Classification Search
USPC ..... 99/467, 468, 474, 476, 473, 401, 447; 219/405, 411, 400, 680; 392/416
See application file for complete search history.

(56) References Cited

U.S. PATENT DOCUMENTS

| | | | | |
|---|---|---|---|---|
| 4,551,616 | A | 11/1985 | Buttery | |
| 5,036,179 | A * | 7/1991 | Westerberg et al. | 219/411 |
| 5,097,112 | A * | 3/1992 | Kanaya et al. | 219/411 |
| 6,316,757 | B1 * | 11/2001 | Kim et al. | 219/680 |
| 6,528,772 | B1 * | 3/2003 | Graves et al. | 219/680 |
| 7,348,521 | B2 * | 3/2008 | Lee et al. | 219/402 |
| 7,489,858 | B2 * | 2/2009 | Zank et al. | 392/416 |
| 7,910,861 | B2 * | 3/2011 | Nam et al. | 219/400 |
| 8,106,334 | B2 * | 1/2012 | Nam | 219/400 |
| 8,126,319 | B2 * | 2/2012 | De Luca | 392/416 |
| 2008/0128405 | A1 | 6/2008 | Nam | |

FOREIGN PATENT DOCUMENTS

| | | | |
|---|---|---|---|
| CN | 1293882 | A | 5/2001 |
| CN | 1315632 | A | 10/2001 |
| EP | 1 062 843 | B1 | 12/2000 |
| JP | 05-187644 | A | 7/1993 |
| JP | 11-182856 | A | 7/1999 |
| JP | 2002-106853 | A | 4/2002 |
| JP | 2003-019075 | A | 1/2003 |
| KR | 10-1996-0001682 | B1 | 2/1996 |
| WO | WO0042823 | A1 | 7/2000 |

OTHER PUBLICATIONS

International Search Report dated Nov. 9, 2010 for Application No. PCT/KR2010/002264, 3 pages.

(Continued)

*Primary Examiner* — Reginald L Alexander
(74) *Attorney, Agent, or Firm* — Fish & Richardson P.C.

(57) ABSTRACT

The present invention relates to a cooker. In the present invention, a carbon heater is used to cook foods in a cooking chamber and electric current applied to the carbon heater is controlled by a switching element, such that an effective wavelength range and an available temperature range of energy generated from the carbon heater is adjusted. Therefore, according to the present invention, it is possible more efficiently cook foods, using the carbon heater.

16 Claims, 10 Drawing Sheets

(56) References Cited

OTHER PUBLICATIONS

Chinese Office Action dated Aug. 27, 2013 for Application No. 201080019655.3, 5 pages.

Chinese Office Action dated May 16, 2014 for CN Application No. 201080019655.3, in English, 8 pages.

* cited by examiner

COOKER

CROSS REFERENCES RELATED APPLICATIONS

The present application claims priority under 35 U.S.C. 119 and 35 U.S.C. 365 to Korean Patent Application No. 10-2009-0043926 (filed on May 20, 2009), which is herein expressly incorporated by reference in its entirety.

FIELD

The present application relates to a cooker, in detail, a cooker using a heater as a heating source.

BACKGROUND

A cooker is one of appliances for cooking by heating foods, using gas or electricity. In particular, the cooker using electricity is equipped with an electric heater as a heating source for heating foods. As the electric heater, there are various heaters, such as a sheath heater, a halogen heater, and a carbon heater.

SUMMARY

As one aspect, a cooker includes: a cooking chamber that is positioned in a cavity, that is defined by at least one inner walls of the cooker, configured to cook foods; a carbon heater configured to supply radiation energy to the cooking chamber for cooking the foods inside the cooking chamber; an input unit configured to receive a signal for operating the cooker; and a switching element configured to provide electric current to the carbon heater based on the signal received by the input unit.

As another aspect, a cooker includes: a cavity; a cooking chamber that is positioned in the cavity, that is defined by at least one inner walls of the cooker, configured to cook foods; a carbon heater configured to supply radiation energy to the cooking chamber for cooking the foods inside the cooking chamber; a switching element is configured to provide electric current to the carbon heater; and a support member is coupled to the cavity and configured to support the carbon heater.

In yet another aspect, a cooker includes: a cavity that has a cooking chamber where foods are cooked and an opening for supplying energy to the cooking chamber; at least one carbon heater that supplies radiation energy for cooking foods to the cooking chamber through the opening; a switching element that controls electric current applied to the carbon heater; a covering member that is disposed above the opening, between the cooking chamber and the carbon heater, and transmits the radiation energy of the carbon heater to the inside of the cooking chamber; and support members that support the carbon heater, in which the switching element controls electric current applied to the carbon heater to generate radiation energy at different wavelength ranges or temperature ranges.

DETAILED DESCRIPTION

Figure 1:
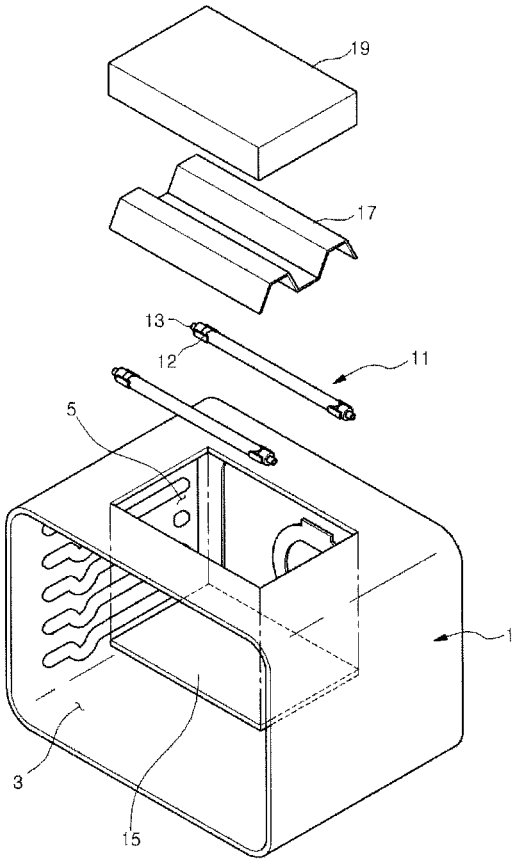
FIG. 1 is a view of a cooker.

Referring to FIG. 1, a cooking chamber 3 is positioned inside of a cavity 1. The cooking chamber 3 is where food is cooked. An opening unit 5 is positioned at an upper surface of the cavity 1. The opening unit 5 is configured to supply energy of a carbon heater 11, which will be described below, to the inside of the cooking chamber 3.

The carbon heater 11 is disposed above the cavity 1. The carbon heater 11 provides energy for cooking food inside the cooking chamber 3 to the inside of the cooking chamber 3. In some examples, the carbon heater 11 includes a tube, a filament, and an inert gas. The tube is made of a material of which at least a portion is transparent or semi-transparent. The filament is made of a carbon material and disposed in the tube. The inert gas is sealed in the tube in which the filament is disposed. Packets 12 for fixing insulators 13 are positioned at both ends of the carbon heater 11. The carbon heater 11 substantially supplies heat and light to the inside of the cooking chamber 3. The heat and light generated from the carbon heater 11 are transmitted to the inside of the cooking chamber 3 through the opening unit 5 to cook food inside the cooking chamber 3. In this implementation, the carbon heater 11 generates heat and light at a predetermined bandwidth and temperature. This will be described below.

Further, the opening unit 5 is covered by a ceramic glass 15. For example, the ceramic glass 15 is positioned between the opening unit 5 and the carbon heater 11. Therefore, the energy of the carbon heater 11 is transmitted to the inside of the cooking chamber through the ceramic glass 15, but contaminant substances generated while cooking food inside the cooking chamber 3 are not transmitted to the carbon heater 11.

A reflector 17 is positioned above the carbon heater 11. The reflector 17 reflects the energy of the carbon heater 11 into the cooking chamber 3.

In this implementation, the carbon heater 11 and the reflector 17 are covered by a heat cover 19. The heat cover 19 prevents the energy of the carbon heater 11 from leaking outside the cavity 1.

Figure 2:
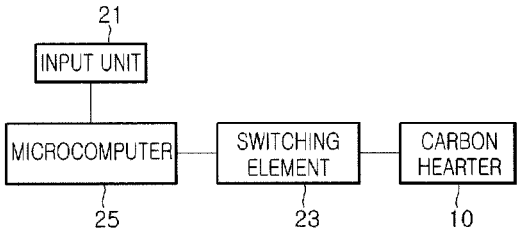
FIG. 2 is a block diagram of a cooker.

Referring to FIG. 2, a cooler includes an input unit 21 that receives an operational signal for operation of the carbon heater 11, a switching element 23 that provides electric current to the carbon heater 11, and a microcomputer 25 that controls the operation of the switch element 23 in response to the operational signal that the input unit 21 receives.

In some implementations, the input unit 21 receives an operational signal for controlling electric current that is applied to the carbon heater 11. For example, the input unit 21 may receive an operational signal for selecting the type of foods in the cooking chamber 3.

A converter or a triac that linearly controls the electric current applied to the carbon heater 11 can be used as the switching element 23. The switching element 23 may change a wavelength range of the energy generated from the carbon heater 11 by changing the electric current applied to the carbon heater 11.

The microcomputer 25 controls the operation of the switching element 23 such that the carbon heater 11 supplies energy at different wavelength ranges to the inside of the cooking chamber 3, in response to the operational signal that the input unit 21 receives. For example, the microcomputer 25 controls the operation of the switching element 23 such that the carbon heater 11 supplies radiation energy at an effective wavelength range to the inside of the cooking chamber 3. The effective wavelength range is a wavelength range that foods in the cooking chamber 3 can the most efficiently absorb in accordance with the types of the foods.

The operation of the cooker according to the present invention is described hereafter in detail with FIGS. 2-6.

First, a user inputs an operational signal to the input unit 21. The user, for example, can input an operational signal for selecting the types of foods, such as meat or vegetable, to the input unit 21. In this implementation, when the user inputs a menu key, the types of foods are displayed on a display unit. Then, the user selects a type of the food, the microprocessor 25 detects the operation signal.

Further, the microcomputer 25 controls the operation of the switching element 23 such that the carbon heater 11 supplies energy at a predetermined effective wavelength range to the inside of the cooking chamber in response to the operational signal that the input unit 21 receives. For example, the microcomputer 25 controls the operation of the switching element 25 such that the carbon heater 11 supplies energy at an effective wavelength range of 1.4~5 μm to the inside of the cooking chamber 3. Or the effective wavelength may be 1.5-2.5 μm.

The food is cooked in the cooking chamber 3 by the energy supplied from the carbon heater 11. However, as described above, the carbon heater 11 supplies energy at an effective wavelength range, where the food can be effectively cooked in the cooking chamber 3, in accordance with the operational signal that the input unit 21 receives. Therefore, it is possible to improve the cooking efficiency and reduce the cooking time for the food in the cooking chamber 3.

Figure 3:
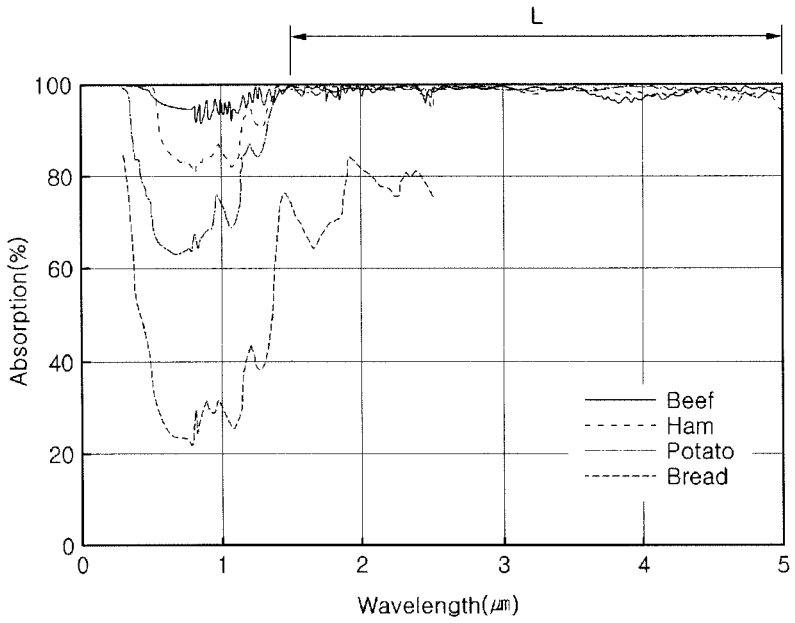
FIG. 3 is a graph showing energy absorption.

Referring to FIG. 3, as a result of an experiment for main foods, such as beef, ham, potato, and bread, it shows that a wavelength range of 1.4~5 μm is an effective wavelength range for the main foods, where the energy absorption ratio of the main foods is good. Further, the carbon heater 11 supplies energy at an effective wavelength range, where the foods in the cooking chamber 3 are efficiently cooked, in effective wavelength ranges under the above effective wavelength range, to the inside of the cooking chamber 3. For example, the carbon heater 11 supplies the maximum radiation energy at the effective wavelength range to the inside of the cooking chamber 3. Accordingly, efficient cooking may be achieved by the carbon heater 11 in accordance with detected as being in the types of food in the cooking chamber 3 by the carbon heater 11.

Figure 4:
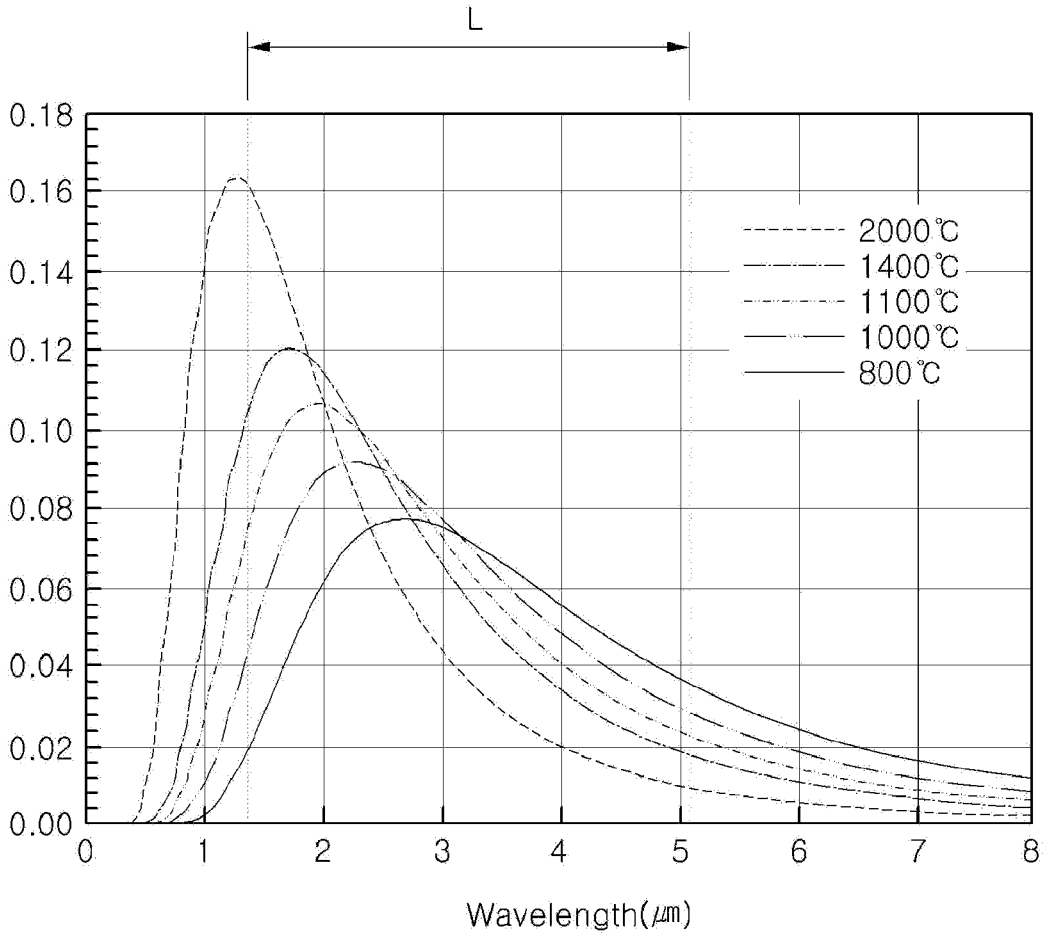
FIG. 4 is a graph showing radiation spectrum.
Figure 5:
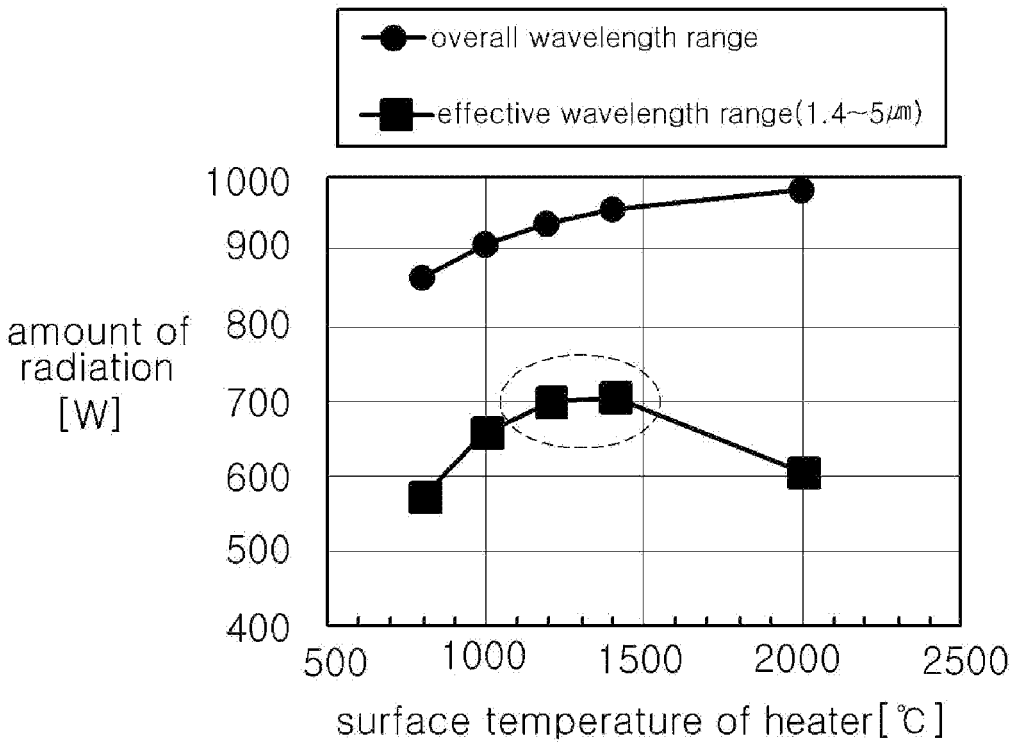
FIG. 5 is a graph showing an amount of radiation to surface temperature of heater.
Figure 6:
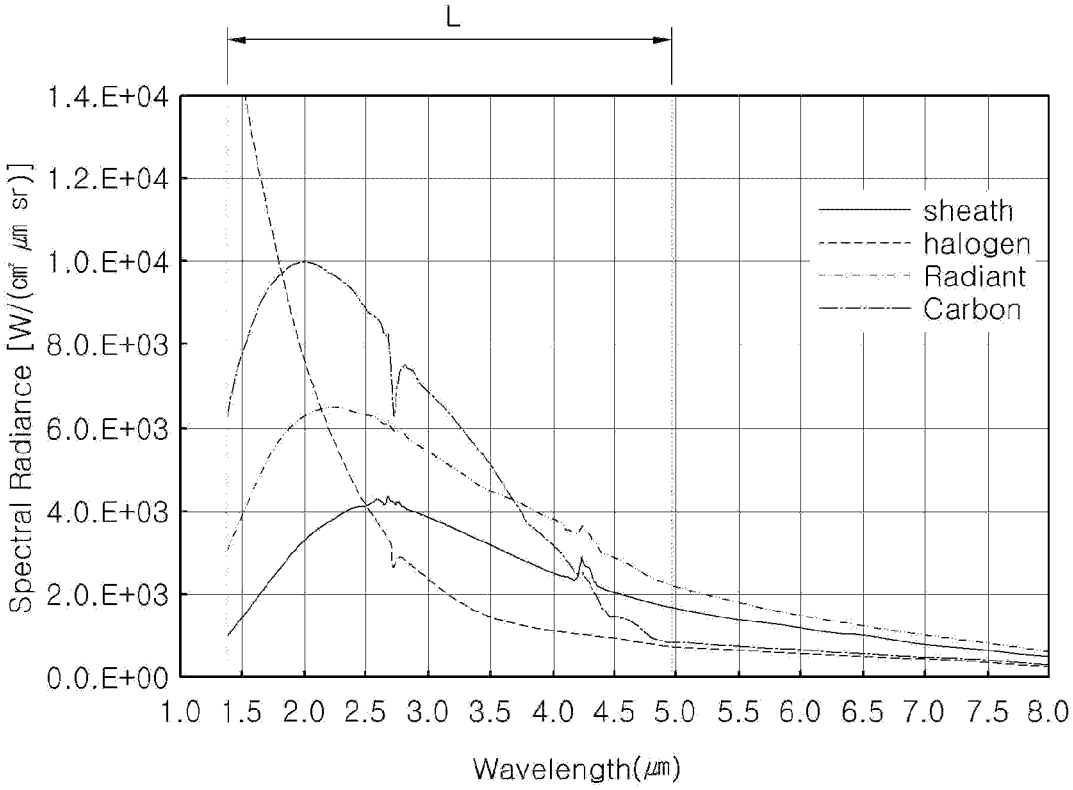
FIG. 6 is a graph showing spectral radiance to wavelength of a carbon heater and a halogen heater.

Next, referring to FIGS. 4 and 5, as a heater having a large amount of radiation at about a wavelength range of 1.4~5 μm for main foods, a heater of which the surface temperature is about 1000~1400° C. may be advantageous. For example, in FIG. 3, energy at a wavelength included in the effective wavelength range is the largest at a temperature within 1000~1400° C., and referring to FIG. 5 which shows a graph obtained by integrating FIG. 4 for each wavelength, it can be directly seen that the energy at the effective wavelength range is the largest at a temperature within 1000~1400° C. Further, referring to FIG. 6, the carbon heater has more amount of radiation than other heaters, for example, a halogen heater, at the effective wavelength range (about 1.4~5 μm) of the main foods. Therefore, the carbon heater 11 can be more efficiently used for cooking the foods, as compared with other heaters, e.g., a sheath heater, a halogen heater, and a radiant heater.

Further, the radiation energy of the carbon heater 11 can be explained by temperature, for example, in accordance with the relationship between the wavelength range and the temperature as shown in FIG. 5. It may be said that the carbon heater 11 supplies energy at the maximum temperature of 1500° C. or less, for example, 1000° C. or more and 1400° C. or less, to the inside of the cooking chamber 3. The temperature of the radiation energy supplied to the inside of the cooking chamber 3 by the carbon heater 11 is implemented by the operation of the switching element 23 that is controlled by the microcomputer 25.

Next, the following Table 1 shows temperature, temperature increase amount, and power consumption cost for each heater, according to the types of foods.

TABLE 1

| | | | halo | ceramic | Sheath | carbon |
|---|---|---|---|---|---|---|
| surface temperature of heater (° C.) | | | 2000 | 1000 | 900 | 1300 |
| tem-perature increase (Δt ° C.) | foods (cooking time) | steak (15 min) | 31.6 | 24.2 | 23.1 | 26.7 |
| | | ham (10 min) | 27.5 | 24.9 | 23.6 | 30.4 |
| | | potato (15 min) | 37.0 | 34.8 | 29.2 | 44.0 |
| | | bread (4 min) | 801 | 22.8 | 5.1 | 26.3 |
| power consumption cost (/1 Kw) | | | 8500 | | | 8000 |

Referring to Table 1, for the carbon heater 11, it can be seen that the temperature increase amount in heating and cooking the main foods is larger than other heaters. In other words, it can be proved that the carbon heater 11 generates relatively a large amount of energy at the effective wavelength range, such that relatively a large amount of energy is used for cooking the foods.

Additionally, since a relatively large amount of energy is used or cooking the food, the time for cooking the foods is shortened, such that the cooking efficiency of the cooker is improved and it is apparent that high energy efficiency of the cooker is expected.

Figure 7:
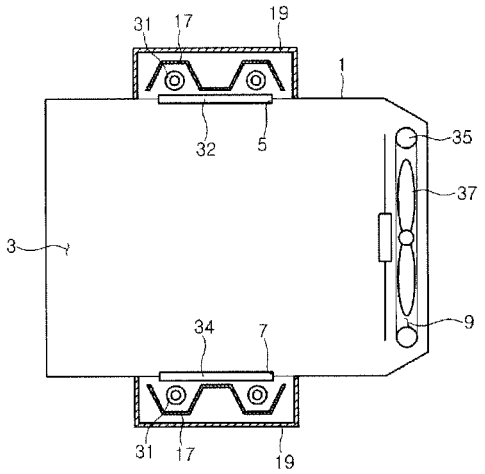
FIG. 7 is a vertical view of a cooker.

Referring to FIG. 7, a cooking chamber 3 is positioned in the cavity 1. Opening units 5 and 7 are defined at the top and the bottom of the cavity 1. Further, a convection chamber 9 communicating with the cooking chamber 3 is positioned at the rear portion of the cavity 1.

Further, a plurality of heating sources that supply energy for cooking food inside the cooking chamber 3 is provided. In this implementation, the heating source may include an upper heater 31, a lower heater 33, and a convection heater 35.

For example, the upper heater 31 and the lower heater 33 are positioned at the upper and lower portions, respectively of the cavity 1, which correspond to the upper and lower portion of the opening units 5 and 7. The upper heater 31 and the lower heater 33 supply energy to the inside of the cooking chamber 3 through the opening unit 5 defined at the top or the bottom of the cavity 1.

Further, the convection heater 35 is positioned in the convection chamber 9. The convection heater 35 supplies energy to inside the cooking chamber 3 and the convection chamber 9. In order to achieve this configuration, a convection fan 37 is positioned in the convection chamber 9.

A carbon heater can be used for at least one of the upper heater 31, lower heater 33, and convection heater 35. The configuration and the operation of the carbon heater are the same as the implementation described previously, such that the detailed description is not provided.

Ceramic glasses 32 and 34 are positioned at the opening units 5 and 7, respectively, between the upper heater 31 and the cooking chamber 3, and between the lower heater 33 and the cooking chamber 3. The ceramic glasses 32 and 34 transmit energy of the upper heater 31 and the lower heater 33 to the inside of the cooking chamber 3 to reduce or prevent contamination of the upper heater 31 and the lower heater 33 because contaminant substances are generated in a process of cooking foods in the cooking chamber 3.

Further, a reflector 17 that reflects the energy of the upper heater 31 or the lower heater 33 to the inside of the cooking chamber 3. And a heater cover 19 that covers the upper heater 31 or the lower heater 33 and the reflector 17 may be located at the upper portion or the lower portion of the cavity 1. The detailed configuration of the reflector 17 and the heater cover 19 is the same as that of the implementation described previously in detail.

Figure 8:
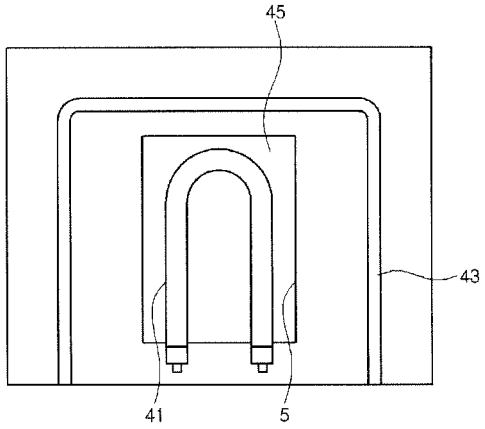
FIG. 8 is a plan view showing main parts of a cooker.

Referring to FIG. 8, an opening unit 5 is positioned at the upper surface of a cavity 1. A first upper heater 41 is positioned above of the opening 5, e.g., above the cavity 1 and a second upper heater 43 is positioned in a cooking chamber 3 (see FIG. 1). The carbon heater is used for the first upper heater 41 and at least one of a sheath heater, a ceramic heater, and a halogen heater is used for the second upper heater 43 In this implementation, the projection of the second upper heater 43 positioned on the bottom of the cooking chamber 3 does not overlap the projection of the first upper heater 41 positioned on the bottom of the cooking chamber 3. For example, the first upper heater 41 may be positioned on the opening unit 5 and the second upper heater 43 may be positioned around the opening unit 5. This configuration is for preventing heat interference between the first and second upper heaters 41 and 43, for example, preventing the second upper heater 43 from interfering with energy supply from the first upper heater 41 into the cooking chamber 3, or the second upper heater 43 from being damaged by radiation energy of the first upper heater 41. Further, a ceramic glass 45 is positioned above the opening unit 5, e.g., between the cooking chamber 3 and the first upper heater 41.

Figure 9:
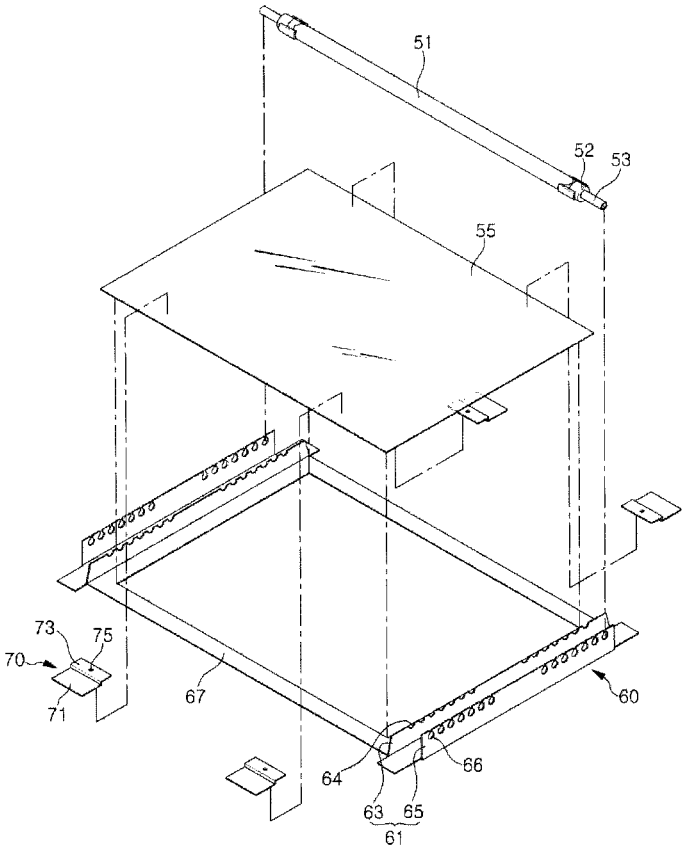
FIG. 9 is an exploded e view showing main parts of a cooker.

Referring to FIG. 9, a support member 60 supports a carbon heater 51 and a ceramic glass 55. In order to achieve this configuration, the support member 60 includes a plurality of heater support parts 61 (e.g., two heater support parts) and a glass support part 67. Further, the heater support parts 61 and the glass support part 67 are integrally defined.

In some examples, the heater support parts 61 support both ends of the carbon heater 51, respectively. Each of the heater support parts 61 has first heater support ribs 63 supporting packets 52 of the carbon heater 51 and second heater support ribs 65 supporting insulators 53 of the carbon heater 51. Accordingly, the first heater support ribs 63 are spaced apart about as much as the distance between the packets of the carbon heater 51 and the second heater support ribs 65 are spaced apart as much as the distance between the insulators of the carbon heater 51. A plurality of packet-seating grooves 64 is defined in the first heater support ribs 63 and a plurality of insulator-seating grooves 65 is defined in the second heater support ribs 65. The of packet-seating grooves 64 and the insulator-seating grooves 65 are defined by cutting portions of the first and second heater support ribs 63 and 65, respectively, and the packets 52 and the insulators 53 of the carbon heater 51 are seated in the packet-seating grooves 64 and the insulator-seating grooves 65.

The glass support part 67 is positioned between the heater support parts 61, for example, between the first heater support ribs 63. The glass support part 67 is defined in a shape substantially corresponding to the ceramic glass 55, for example, in a rectangular frame shape. The bottom edge of the ceramic glass 55 is supported by the glass support part 67. Further, the first and second heater support ribs 63 and 65 protrude upward from both ends of the glass support part 67, such that the heater support parts 61 are integrally defined with the glass support part 67.

The support member 60 is fixed to the upper surface of the cavity 1, for example, to the upper surface of the cavity 1 which is adjacent to the opening unit 5. With the support member 60 fixed to the upper surface of the cavity 1, the carbon heater 51 and the ceramic glass 55 are supported by the support member 60.

Also, support brackets 70 connect the bottom of the ceramic glass 55 to the upper surface of the glass support part 67, with the ceramic glass 55 supported by the glass support part 67. In this implementation, the support bracket 70 has a fixing portion 71 and a contacting portion 73. The fixing portion 71 is a portion that is fixed to the upper surface of the cavity 1. The contacting portion 73 is stepped upward at a predetermined height from the fixing portion 71, for example, stepped over the thickness of the ceramic glass 55 and closely contacts to the upper surface of the ceramic glass 55. Further, a pressing portion 75 is formed on the bottom of the contacting portion 73. The pressing portion 75 may be defined in a semi-spherical shape protruding downward from the bottom of the contacting portion 73. The pressing portion 75 presses the ceramic glass 55.

Figure 10:
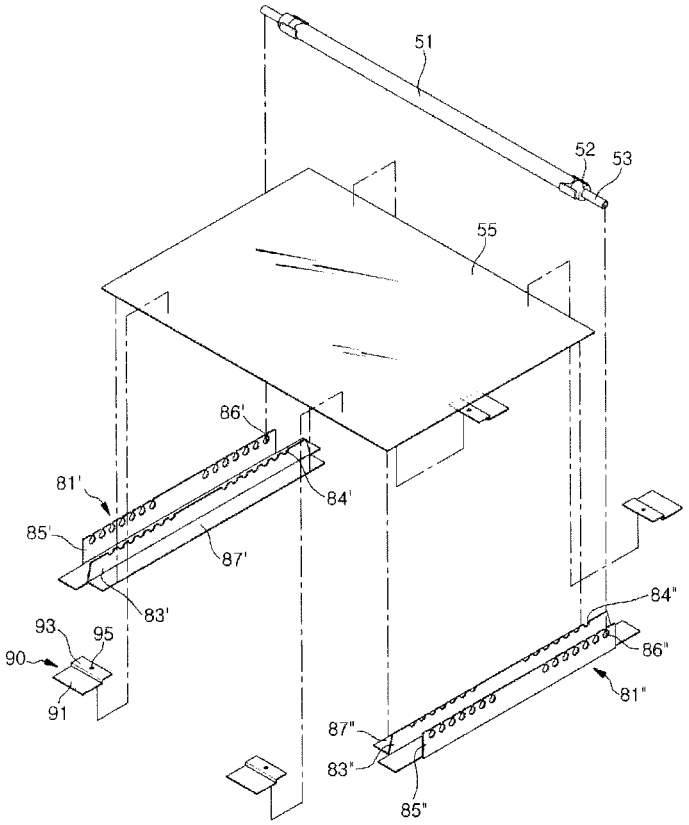
FIG. 10 is an exploded view showing main parts of a cooker.

Referring to FIG. 10, the carbon heater 51 is supported by first and second support members 81' and 81". Further, a ceramic glass 55 is supported by the first and second support members 81' and 81" and the upper surface of a cavity 1.

The first support member 81' supports one end of the carbon heater 51 and one end of the ceramic glass 55. The second support member 81" supports the other end of the carbon heater 51 and the other end of the ceramic glass 55. Further, the other both ends of the ceramic glass 55 are supported by the upper surface of the cavity 1, for example, the upper surface of the cavity 1 which is adjacent to an opening 5.

The first and second support members 81' and 81" respectively have first and second heater support ribs 83', 83", 85', and 85" and glass support parts 87' and 87". The first and second heater support ribs 83', 83", 85', and 85" protrude upward from the upper surfaces of the first and second support members 81' and 81", respectively. A plurality of packet-seating grooves 84' and 84" where packets 52 of the carbon heater 51 are seated and a plurality of insulator-seating grooves 86' and 86" where insulators 53 of the carbon heater 51 are defined in the first and second heater support ribs 83', 83", 85', and 85", respectively.

Further, the first and second support members 81' and 81" respectively have glass support portions 87' and 87". The glass support portions 87' and 87" horizontally extend from ends of the first and second heater support ribs 83', 83", 85', and 85" which are adjacent to the first heater support ribs 83' and 83". Both ends of the ceramic glass 55 are supported by the glass support portions 87' and 87".

Although all the upper heater, lower heater, and the convection heater are used for heating sources that supply energy to the inside of the cooking chamber, two of the three heating sources may be used.

Further, although the upper heater, or the upper heater, lower heater, and convection heater are exemplified in the implementations, other heating sources, for example, a high-frequency heating source that generates microwaves radiated into the cooking chamber may be used for the heating source.

The following effects can be expected from a cooker.

First, energy of a carbon heater is adjusted in an effective wavelength range and an available temperature range by controlling electric current applied to the carbon heater. Also, the carbon heater and ceramic glass are supported by support members.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A cooker comprising:

a cavity;

a cooking chamber that is positioned in the cavity, that is defined by at least one inner wall of the cooker, configured to cook foods;

a heater configured to supply radiation energy to the cooking chamber for cooking the foods inside the cooking chamber;

a covering member positioned between the heater and the cooking chamber and configured to transmit the radiation energy to the inside of the cooking chamber; and a support member coupled to the cavity and configured to support the heater and the covering member, wherein the support member comprises a plurality of heater support parts configured to support both ends of the heater, and a glass support part connecting the plurality of heater support parts and configured to support the covering member, wherein the plurality of heater support parts are connected by the glass support part and extend upward from an upper portion of the glass support part.

2. The cooker of claim 1, wherein the plurality of heater support parts and the glass support part are integrally formed.

3. The cooker of claim 1, wherein the support member comprises:

a first support member configured to support one end of the heater; and a second support member configured to support the other end of the heater.

4. The cooker of claim 1, further comprising:

a support bracket connecting the bottom of the covering member to an upper surface of the glass support part.

5. The cooker of claim 1, wherein the support member is configured to be fixed to an upper surface of the cavity.

6. The cooker of claim 1, wherein the heater comprises a carbon heater, wherein the cooker further comprises an input unit configured to receive a signal for operating the cooker, and a switching element configured to provide electric current to the carbon heater based on the signal received by the input unit.

7. The cooker of claim 6, wherein the carbon heater is configured to supply the radiation energy at a predetermined wavelength range.

8. The cooker of claim 6, wherein the carbon heater supplies the radiation energy at a predetermined temperature range.

9. The cooker of claim 7, wherein the carbon heater supplies the radiation energy at a wavelength range of 1.4~5 μm.

10. The cooker of claim 7, wherein the carbon heater supplies the radiation energy at a wavelength range of 1.5~2.5 μm.

11. The cooker of claim 8, wherein the carbon heater supplies the radiation energy at temperature of 1000° C. or more and 1500° C. or less to the inside of the cooking chamber.

12. The cooker of claim 8, wherein the carbon heater supplies the radiation energy at temperature of 1000° C. or more and 1400° C. or less to the inside of the cooking chamber.

13. The cooker of claim 6, further comprising:

at least one of a sheath heater, a ceramic heater, or a halogen heater that are positioned between the carbon heater and one side of the cooking chamber and configured to supply energy to the cooking chamber.

14. The cooker of claim 6, further comprising:

a controller configured to control the switching element in response to the received signal.

15. The cooker of claim 2, wherein the glass support part is configured in a shape substantially corresponding to a frame surrounding the covering member, and the plurality of heater support parts protrude upward from opposite ends of the glass support part.

16. A cooker comprising:

a cavity;

a cooking chamber that is positioned in the cavity, that is defined by at least one inner wall of the cooker, configured to cook foods;

a heater configured to supply radiation energy to the cooking chamber for cooking the foods inside the cooking chamber;

a covering member positioned between the heater and the cooking chamber and configured to transmit the radiation energy to the inside of the cooking chamber; and a support member coupled to the cavity and configured to support the heater and the covering member, wherein the support member comprises:

a first glass support part configured to support one end of the covering member;

a second glass support part configured to support the other end of the covering member;

a first heater support part extended upward from an upper portion of the first glass support part and configured to support one end of the heater, and a second heater support part extended upward from an upper portion of the second glass support part and configured to support the other end of the heater.

* * * * *